US011325747B2

(12) United States Patent
Banik et al.

(10) Patent No.: US 11,325,747 B2
(45) **Date of Patent: *May 10, 2022**

(54) BULK CONTAINER WITH INTERLOCKING FEATURES

(71) Applicant: ORBIS Corporation, Oconomowoc, WI (US)

(72) Inventors: Joachim Banik, Oconomowoc, WI (US); Arndt Stiebritz-Ulrich, Bucha (DE)

(73) Assignee: ORBIS Corporation, Oconomowoc, WI (US)

( * ) Notice: Subject to any disclaimer, the term of this patent is extended or adjusted under 35 U.S.C. 154(b) by 167 days.

This patent is subject to a terminal disclaimer.

(21) Appl. No.: 16/851,897

(22) Filed: Apr. 17, 2020

(65) Prior Publication Data

US 2020/0239187 A1 Jul. 30, 2020

Related U.S. Application Data

(63) Continuation of application No. 16/353,764, filed on Mar. 14, 2019, now Pat. No. 10,654,618, which is a (Continued)

(51) Int. Cl.
*B65D 19/18* (2006.01)
*B65D 21/02* (2006.01)

(52) U.S. Cl.
CPC ..... *B65D 21/0213* (2013.01); *B65D 19/18* (2013.01); *B65D 21/02* (2013.01); (Continued)

(58) Field of Classification Search
CPC .... B65D 21/0213; B65D 19/18; B65D 21/02; B65D 21/0201; B65D 21/0215; (Continued)

(56) References Cited

U.S. PATENT DOCUMENTS 4,119,263 A 10/1978 Cuthbertson et al.
4,591,065 A 5/1986 Foy
(Continued)

FOREIGN PATENT DOCUMENTS

DE 102008047859 A1 4/2010
EP 1084957 A1 3/2001
(Continued)

OTHER PUBLICATIONS

European Patent Office; Communication pursuant to Article 94(3) EPC for European Application No. 17803406.2; dated Sep. 17, 2020; 6 pages.
(Continued)

*Primary Examiner* — Don M Anderson
(74) *Attorney, Agent, or Firm* — Greensfelder, Hemker & Gale, P.C.; Richard C. Himelhoch

(57) ABSTRACT

A container having interlocking features is provided. The container includes protrusions on the upper edges of the side wall panels and base wall panels, and notches in the runners/feet for receiving the protrusions. The runners and/or feet extend to the outer perimeter of the container so they can rest on an upper edge of a like container, and do not include a recess from the outer perimeter.

20 Claims, 10 Drawing Sheets

Related U.S. Application Data continuation of application No. 15/600,911, filed on May 22, 2017, now Pat. No. 10,457,444.

(60) Provisional application No. 62/348,509, filed on Jun. 10, 2016, provisional application No. 62/340,798, filed on May 24, 2016.

(52) U.S. Cl.
CPC ..... *B65D 21/0201* (2013.01); *B65D 21/0215* (2013.01); *B65D 2519/009* (2013.01); *B65D 2519/00034* (2013.01); *B65D 2519/00069* (2013.01); *B65D 2519/0096* (2013.01); *B65D 2519/00174* (2013.01); *B65D 2519/00208* (2013.01); *B65D 2519/00288* (2013.01); *B65D 2519/00333* (2013.01); *B65D 2519/00587* (2013.01); *B65D 2519/00646* (2013.01); *B65D 2519/00711* (2013.01); *B65D 2519/00805* (2013.01); *B65D 2519/00975* (2013.01)

(58) Field of Classification Search
CPC ..... B65D 2519/00034; B65D 2519/00069; B65D 2519/00174; B65D 2519/00208; B65D 2519/00288; B65D 2519/00333; B65D 2519/00587; B65D 2519/00646; B65D 2519/00711; B65D 2519/00805; B65D 2519/009; B65D 2519/0096; B65D 2519/0097; B65D 19/385; B65D 2519/00975
See application file for complete search history.

(56) References Cited

U.S. PATENT DOCUMENTS

| | | | | |
|---|---|---|---|---|
| 5,094,356 | A | 3/1992 | Miller | |
| 5,709,314 | A | 1/1998 | Petry | |
| 6,062,388 | A | 5/2000 | Ohayon | |
| 6,857,535 | B1 | 2/2005 | Zuckerman | |
| 6,955,273 | B2 | 10/2005 | Harwell | |
| 7,607,564 | B2 | 10/2009 | Churvis et al. | |
| 7,690,555 | B2 | 4/2010 | Churvis et al. | |
| 8,727,158 | B2 | 5/2014 | Nolan | |
| 9,415,898 | B2 | 8/2016 | Nolan | |
| 10,040,612 | B2 | 8/2018 | Kuipers | |
| 10,457,444 | B2 * | 10/2019 | Banik | B65D 21/0215 |
| 10,654,618 | B2 * | 5/2020 | Banik | B65D 21/0213 |
| 2004/0129699 | A1 | 7/2004 | Williams | |
| 2005/0150892 | A1 | 7/2005 | Miller | |
| 2005/0199623 | A1 * | 9/2005 | Elder | B65D 19/18 220/4.28 |
| 2007/0158345 | A1 * | 7/2007 | Booth | B65D 11/1833 220/6 |
| 2007/0181587 | A1 | 8/2007 | Burnham et al. | |
| 2007/0251857 | A1 * | 11/2007 | Watanabe | B65D 19/02 206/600 |
| 2011/0139775 | A1 | 6/2011 | Nolan | |
| 2011/0210027 | A1 | 9/2011 | Decroix | |
| 2013/0026057 | A1 | 1/2013 | Shapiro | |
| 2013/0146591 | A1 | 6/2013 | Miller | |
| 2015/0069055 | A1 | 3/2015 | Jennings | |
| 2017/0341810 | A1 | 11/2017 | Banik | |

FOREIGN PATENT DOCUMENTS

| | | | |
|---|---|---|---|
| EP | 0958177 | B1 | 8/2002 |
| EP | 1076011 | B1 | 10/2003 |
| EP | 1818270 | A1 | 8/2007 |
| EP | 1939101 | B1 | 7/2010 |
| EP | 3464095 | | 4/2019 |
| EP | 3259195 | B1 | 10/2019 |
| GB | 2257422 | A | 1/1993 |
| JP | 2014162554 | A | 9/2014 |
| JP | 2014162556 | A | 9/2014 |
| WO | 9501915 | A2 | 1/1995 |
| WO | 9501915 | A3 | 1/1995 |
| WO | 2011159979 | A1 | 12/2011 |
| WO | 2016132348 | A1 | 8/2016 |
| WO | 2017205352 | A1 | 11/2017 |

OTHER PUBLICATIONS

Korean Intellectual Property Office, International Search Report for International Application No. PCT/US2017/033963, dated Aug. 17, 2017, 3 pages.
Korean Intellectual Property Office, Written Opinion of the International Searching Authority for International Application No. PCT/US2017/033963, dated Aug. 17, 2017, 12 pages.
European Patent Office, Extended European Search Report for European Application No. 17803406.2, dated Nov. 4, 2019, 7 pages.
European Patent Office, Communication pursuant to Rule 114(2) EPC—Third Party Observations for European Application No. 17803406.2, dated Mar. 10, 2020, 35 pages.
European Patent Office; Communication pursuant to Article 94(3) EPC in European Application No. 17803406.2; dated Jul. 9, 2020; 6 pages.
European Patent Office; Extended European Search Report for European Application No. 21190659.9, dated Feb. 10, 2022, 9 pages.

* cited by examiner

BULK CONTAINER WITH INTERLOCKING FEATURES

CROSS-REFERENCE TO RELATED APPLICATIONS

This Application is a continuation of and claims the benefit of U.S. patent Ser. No. 16/353,764 filed Mar. 14, 2019, which is a continuation of U.S. patent application Ser. No. 15/600,911 filed May 22, 2017, now U.S. Pat. No. 10,457,444, which claims priority from U.S. Provisional Patent Application Nos. 62/340,798 filed May 24, 2016, and 62/348,509 filed Jun. 10, 2016, the contents of which are incorporated herein in their entirety by reference and made a part hereof.

FEDERALLY SPONSORED RESEARCH OR DEVELOPMENT

N/A

FIELD OF THE INVENTION

The present invention is generally directed to a bulk bin container having interlocking features, and more particularly, to a bulk bin container having side wall panels with upper protrusions and base walls with upper protrusions, and a base portion with runners and/or feet that extend to an outer perimeter of the container and include notches for receiving the protrusions.

DESCRIPTION OF THE PRIOR ART

In order to securely stack two or more containers without the use of top caps (covers), most containers in the field today have a recess around the perimeter of the bottom edge of the base (see e.g., FIG. 1). This recess is typically slightly wider than the thickness of the side walls of the same container, and between approximately W' and 1" tall.

When two open containers are stacked on top of each other, the recess of the upper bin fits inside the side walk of the lower bin, and thus ensures for a secure connection between the two containers that prevents the upper container from sliding off the lower container during transportation and storage. In most cases, the same recess also interfaces with the base walls of a collapsed container, so that secure stacks of collapsed containers can be built in the same manner. If the container has runners or stringers on the bottom that connect individual feet, these runners or stringers do not extend to the outermost surfaces, but instead are part of the recess, so that they sit inside the container side walls or the base walls of the lower container in a stack.

This method of using a recess at the bottom edge of a container in general works well, but has three potential downsides:

(1) The recess reduces the effective footprint of a container, which slightly increases the potential of a stack of containers to tip over. For example, the ORBIS HDR3230 container line has an overall length and width of 32"×30", but the actual contact on the floor measures only 29"×27".

(2) In a stack of loaded containers, the main loads are transferred through the perimeter of the container stack into the ground. Having a recess at the very bottom of the stack creates a bending momentum (the forces have to "flow around the corner"), which under high loads can lead to rotation of the base sidewalls of the lowest container. This can lead to permanent deformation of the base sidewalls or even stack failures.

(3) As explained above, runners at the perimeter of the base need to be reduced in width to form the recess. This weakens the runners, which can lead to very fragile designs or require the use of stronger and typically more expensive materials (e.g. steel or reinforced composites), especially for containers that have a smaller footprint like 32"×30" or 800 mm×1200 mm.

The present invention provides an improved container that overcomes problems associated with the known containers.

SUMMARY OF THE INVENTION

The present invention is a container having protrusions at the top of both the base walls and the side wall panels, that are configure to mate with openings in the feet and/or runners of a like container when stacked. This allows for open (i.e., the side wall panels being in an upright position) and collapsed (i.e., the side wall panels being in a collapsed position) containers to stack with other open and/or collapsed containers. Moreover, (other than the openings for receiving the protrusions) the feet and/or runners extend to the outer perimeter of the container (i.e., a portion of the runners and feet extend to and rest on the upper edge of the side walls or base walls instead of being inset or recessed inwardly from this location). This avoids the problems associated with the known containers having a recessed portion around the perimeter of the bottom of the container.

In accordance with one aspect of the invention, a bulk container having interlocking features about the outside perimeter is provided. The container comprises a rectangular base portion having a first side and an opposing second side, a first end and an opposing second end, and a bottom wall extending between the first side, the second side, the first end and the second end of the base portion. A first side wall panel is connected to the first side of the base portion. The first side wall panel includes a first protrusion extending from an upper edge of the first side wall panel. A second side wall panel is connected to the second side of the base portion. The second side wall panel includes a first protrusion extending from an upper edge of the second side wall panel. A first foot extends from the bottom wall on the first side and has an outer surface that is co-planar with an outer surface of the first side wall panel. The first foot includes a notch in a lower surface for receiving a first protrusion when stacked on a like container.

The lowermost surface of the first foot rests on the upper edge of the side wall panel next to the protrusion (as well as on an adjacent side wall panel). Accordingly, the first foot does not have any portion that sits within the container (i.e., the first foot does not include any portion that extends lower than the upper edge of the side wall panel). This (along with other similar feet on the container) allows for a higher fill height for stacked containers than similarly dimensioned containers having the inset or recessed portion as described in the Background.

Similarly, a first foot extends from the bottom wall on the second side. This first foot has an outer surface that is co-planar with an outer surface of the second side wall panel and a notch in a lower surface for receiving a protrusion when stacked on a like container. Again, the lowermost surface of the first foot rests on the upper edge of the side wall panel next to the protrusion and no portion of the foot is within the container.

The first side wall panel can also include a second protrusion extending from the upper edge of the first side wall panel spaced from the first protrusion on the first side wall panel. Similarly, the second side wall panel can also include a second protrusion extending from the upper edge of the second side wall panel spaced from the first protrusion on the second side wall panel. Additional protrusions can also extend from the upper edge of the first and second side walls.

The base portion can also include a second foot extending from the bottom wall on the first side. The second foot can have an outer surface that is co-planar with the outer surface of the first side wall panel and a notch in a lower surface for receiving a second protrusion when stacked on a like container. Similarly, the base portion can include a second foot extending from the bottom wall on the second side. The second foot can have an outer surface that is co-planar with the outer surface of the first side wall panel and a notch in a lower surface for receiving a second protrusion when stacked on a like container. Additional feet can extend from the bottom of the base portion, either along the first or second sides, or at other locations (e.g., a third row of feet in the middle of the base portion). All of the feet have a lower surface that does not extend into the interior of a lower like container when stacked on the lower container.

A first runner can be connected to the first foot and the second foot extending from the first side of the base portion. Similarly, a second runner can be connected to the first foot and the second foot extending from the second side of the base portion. Additional runners can be included depending on the number and positioning of the feet on the container.

The first runner includes a lower surface. At least a portion of the lower surface of the first runner is positioned to rest on an upper edge of the first side wall of a like lower container when stacked on the lower container. Unlike prior containers, the portion of the first runner resting on the upper edge of the first side wall is not inset or recessed—this allows for a larger foot print. It also allows for loads on the lowermost container, of a stack of like containers having similar runners, to be directly supported through the runner rather than offset by the inset or recess on the lowermost container as described above. The second runner is similarly configured to include a lower surface having at least a portion that rests directly on an upper edge of the second side wall of a like container.

The bulk container can further comprise a first base wall extending upward from the first side of the base portion. Like the first side wall panel, the first base wall includes a first protrusion extending from an upper edge of the first base wall. Similarly, a second base wall can extend upward from the second side of the base portion. The second base wall can include a first protrusion extending from an upper edge of the second base wall.

A second protrusion can extend from the upper edge of the first base wall. A second protrusion can extend from the upper edge of the second base wall. Additional protrusions can extend from the first base wall or the second base wall.

The lower surfaces of the first and second runners are positioned to rest on an upper edges of the first and second base walls respectively (i.e., in a similar manner as the upper edges of the side walls). Again, the runner is not inset within the base walls and loads will flow directly downward to the lowermost container.

The container can include a dust cover having notches to accommodate the protrusions. Alternatively, the container can include a low profile cover or a top cap.

In accordance with another aspect of the invention, a bulk container comprises a rectangular base portion having a first side and an opposing second side, a first end and an opposing second end, and a bottom wall extending between the first side, the second side, the first end and the second end of the base portion. A first base wall extends upward from the first side of the base portion. The first base wall includes a first protrusion extending from an upper edge of the first base wall. A second base wall extends upward from the second side of the base portion. The second base wall includes a first protrusion extending from an upper edge of the second base wall. The container further includes a first foot extending from the bottom wall on the first side. The first foot has an outer surface that is co-planar with an outer surface of the first base wall, and a notch in a lower surface for receiving a first protrusion when stacked on a like container. Similarly, a first foot extends from the bottom wall on the second side. The first foot extending from the second side has an outer surface that is co-planar with an outer surface of the second base wall, and a notch in a lower surface for receiving a protrusion when stacked on a like container.

The first base wall can include a second protrusion extending from the upper edge of the first base wall spaced from the first protrusion on the first base wall. Similarly, the second base wall can include a second protrusion extending from the upper edge of the second base wall spaced from the first protrusion on the second base wall. Additional protrusions can extend upward from either wall.

The base portion can include a second foot extending from the bottom wall on the first side. The second foot has an outer surface that is co-planar with the outer surface of the first base wall panel, and a notch in a lower surface for receiving a second protrusion when stacked on a like container. The base portion can also include a second foot extending from the bottom wall on the second side. The second foot from the second side has an outer surface that is co-planar with the outer surface of the second base wall panel, and a notch in a lower surface for receiving a second protrusion when stacked on a like container.

A first runner can be connected to the first foot and the second foot extending from the first side of the base portion. A second runner can be connected to the first foot and the second foot extending from the second side of the base portion.

Similar to the first aspect of the invention described above, the first runner includes a lower surface wherein at least a portion of the lower surface is positioned to rest on an upper edge of the first base wall. The second runner similarly is configured to include a lower surface having a portion positioned to rest on an upper edge of the second base wall.

The container can further comprise a first side wall panel connected to the first side of the base portion. The first side wall panel can include a first protrusion extending from an upper edge of the first side wall panel. Similarly, a second side wall panel can be connected to the second side of the base portion. The second side wall panel can include a first protrusion extending from an upper edge of the second side wall panel.

The first side wall panel can also include a second protrusion extending from the upper edge of the first side wall panel spaced from the first protrusion on the first side wall panel. Similarly, the second side wall panel includes a second protrusion extending from the upper edge of the second side wall panel spaced from the first protrusion on the second side wall panel.

The first side wall panel can be connected to the first side of the base portion by a rotatable hinge. The second side wall panel can also be connected to the second side of the base portion by a rotatable hinge.

The first side wall panel can include a first notch along a lower edge to accommodate the first protrusion on the first base wall and a second notch on the lower edge to accommodate the second protrusion on the first base wall. The second side wall panel can similarly include a first notch along a lower edge to accommodate the first protrusion on the second base wall and a second notch on the lower edge to accommodate the second protrusion on the second base wall.

Again, like the first aspect, the lower surfaces of the feet and/or runners are configured to rest on the upper edges of the side walls or the base walls.

As used herein, a "like container" is a container that is either identical to the claimed container or one that includes at least the interlocking features (i.e., the protrusions in either the side wall panels or base walls, and notches in the runners and/or feet), feet and/or runners described and claimed herein.

Directional and/or positional terms, such as "upper," "lower," "upward," "top," etc. are used with respect to the position of the container as shown in the Figures and are not meant to limit the scope of the present application (e.g., a foot extending "downward" from the base portion would still cover a similar container that is pushed onto its side).

Further aspects of the present invention are described herein and shown in the Figures.

BRIEF DESCRIPTION OF THE DRAWINGS

To understand the present invention, it will now be described by way of example, with reference to the accompanying drawings in which.

DETAILED DESCRIPTION

Figure 1:
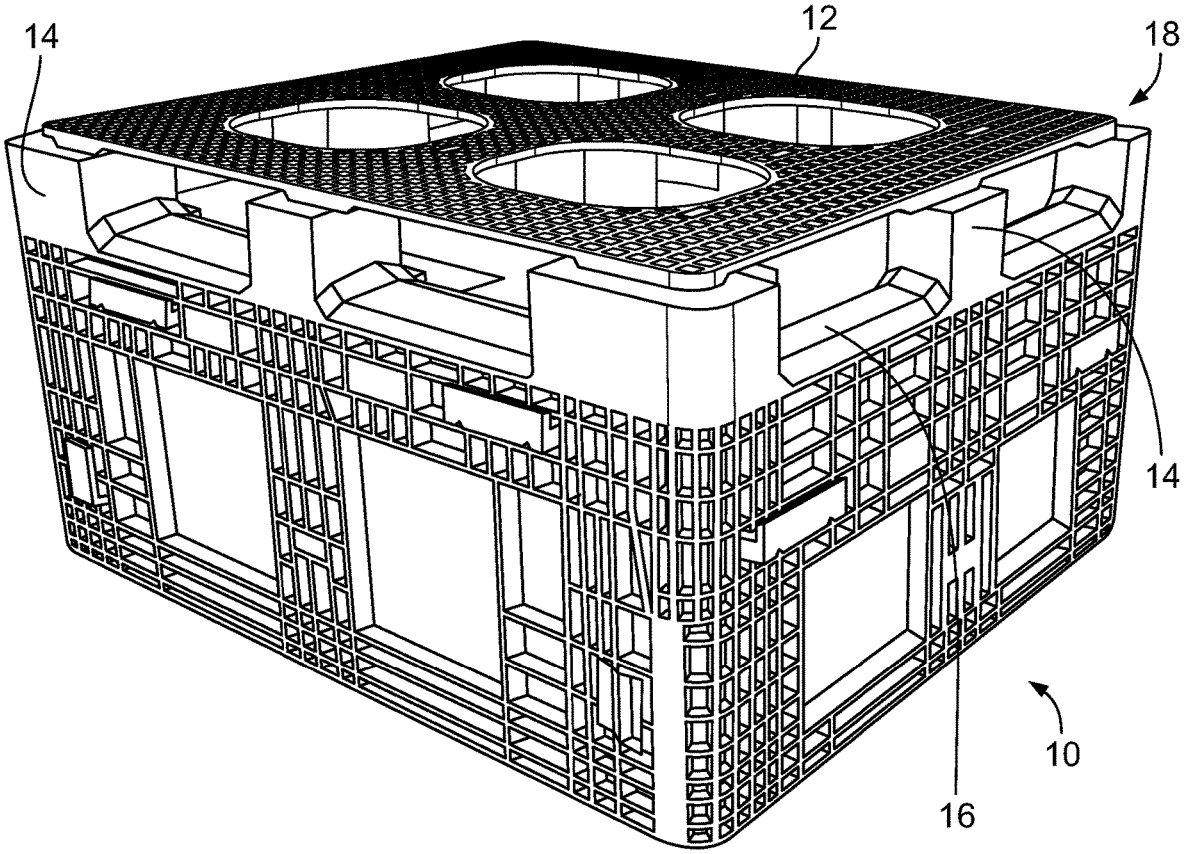
FIG. 1 (Prior Art)
FIG. 1 is a perspective view of the bottom of a known bulk container.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a known container 10 in an upside down position with the bottom features exposed. The container 10 includes a plurality of runners 12 connected to feet 14 extending from a bottom wall 16 of the container 10.

As evident in the Figure, the runners 12 and parts of the feet 14 are positioned inward of the outer perimeter of the container (as generally defined by the outer surface of the side wall panels), forming a recess 18. This allows the runners 12 and parts of the feet 14 to fit within the open end of a like container when stacked (i.e., below the upper edges of the side walls). As discussed above, this configuration results in problems for the lowermost container of the stack which rests on its runners 12 and inset parts of the feet 14. It also requires space in the container to accommodate the runners 12 and feet 14, which means the maximum space for products carried by the container is reduced.

FIGS. 2-12 show containers 20 of the present invention. The containers 20 are formed from plastic and can be used to transport and/or store bulk materials or other suitable items.

The containers have interlocking features at the top of both the side wall panels and the base walls, which interact with features in the feet and/or runners to securely stack with other like containers. However, unlike prior known containers, the containers of the present invention do not have recessed structure around the entirety of the base (i.e., one that fits within the opening of a lower like container) that forms a smaller footprint for the lowermost container of a stack than that shown in FIG. 1.

Figure 2:
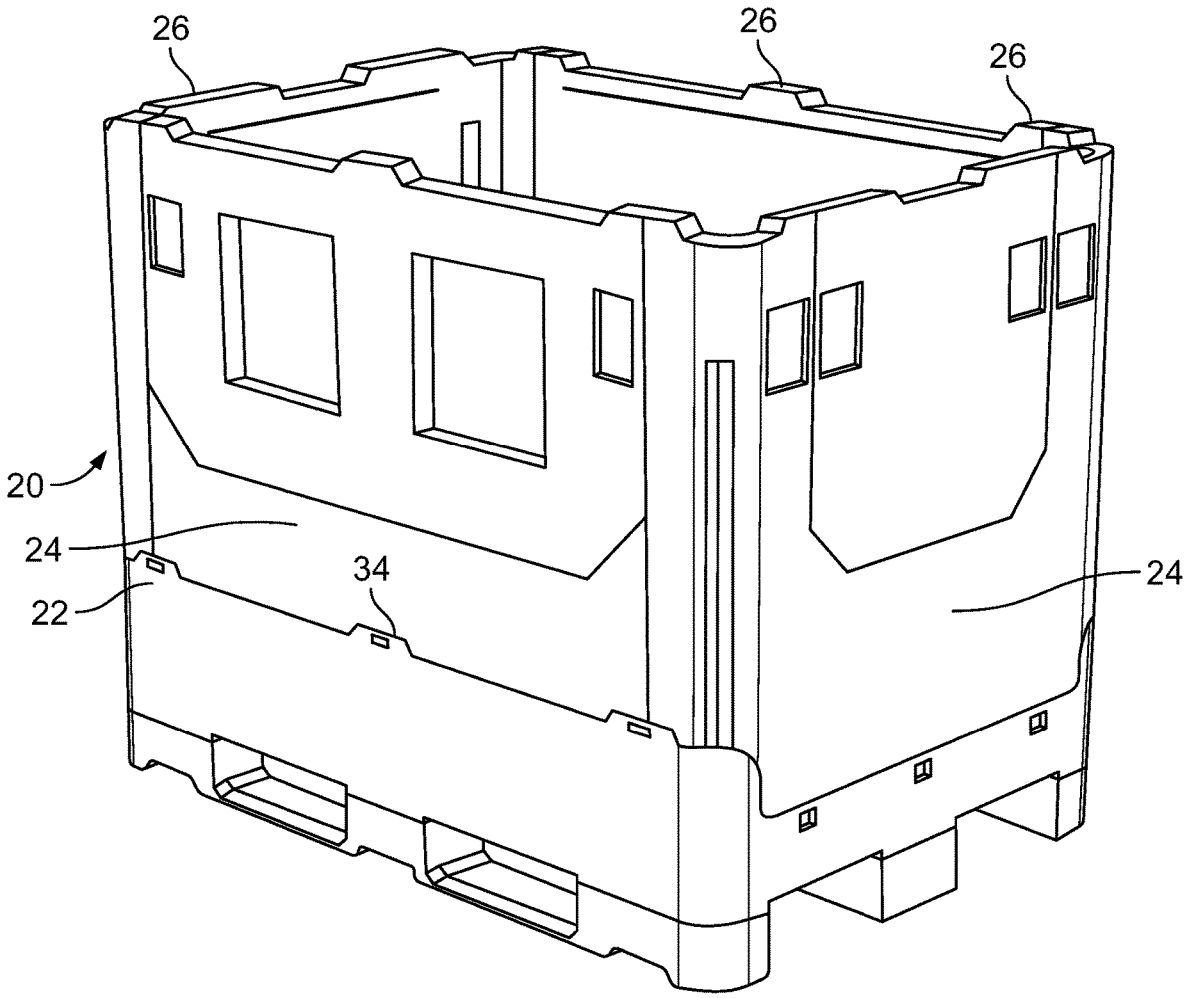
FIG. 2 is a perspective view of an open container in accordance with the present invention.

FIG. 2 shows a container 20 having a rectangular base portion 22 with four side wall panels 24 extending upward to an upright (i.e., "open") position. The side wall panels 24 can be attached to the base portion 22 of the container 20 by one or more hinge elements so that the panels 24 can rotate with respect to the base portion 22. The side wall panels 24 include a number of protrusions 26 that extend upward from the top edges of the side wall panels 24. The protrusions 26 span the thickness of the side wall panels 24.

Figure 3:
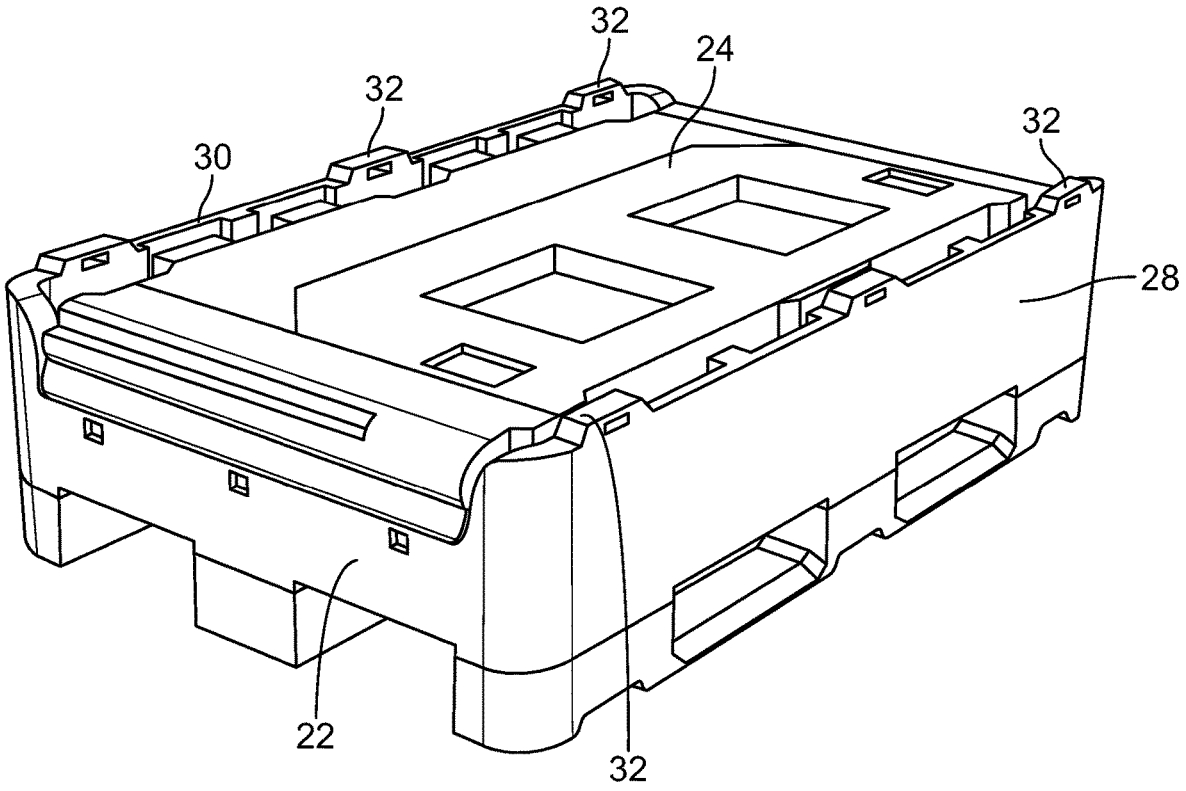
FIG. 3 is a perspective view of the container of FIG. 1 with the side walls in a collapsed position.

FIG. 3 shows the container 20 with the side wall panels 24 rotated downward to a collapsed position. The collapsed side wall panels 24 fit within a first base wall 28 along one side of the base portion 22, and an opposing second base wall 30 along a second side of the base portion 22. The first and second base walls 28, 30 extend upward from a bottom wall 36 of the base portion 22. Each of the first and second base walls 28, 30 also include a plurality of protrusions 32 extending upward from a top edge of each wall 28, 30. Comparing FIGS. 2 and 3, it is evident the side wall panels 24 for the sides of base portion 22 having the first and second base walls 28, 30, are planar with the base walls 28, 30, and include lower notches 42 to accommodate the protrusions 32 on the top edges of the base walls 28, 30 when the side wall panels 24 are rotated upward.

Figure 4:
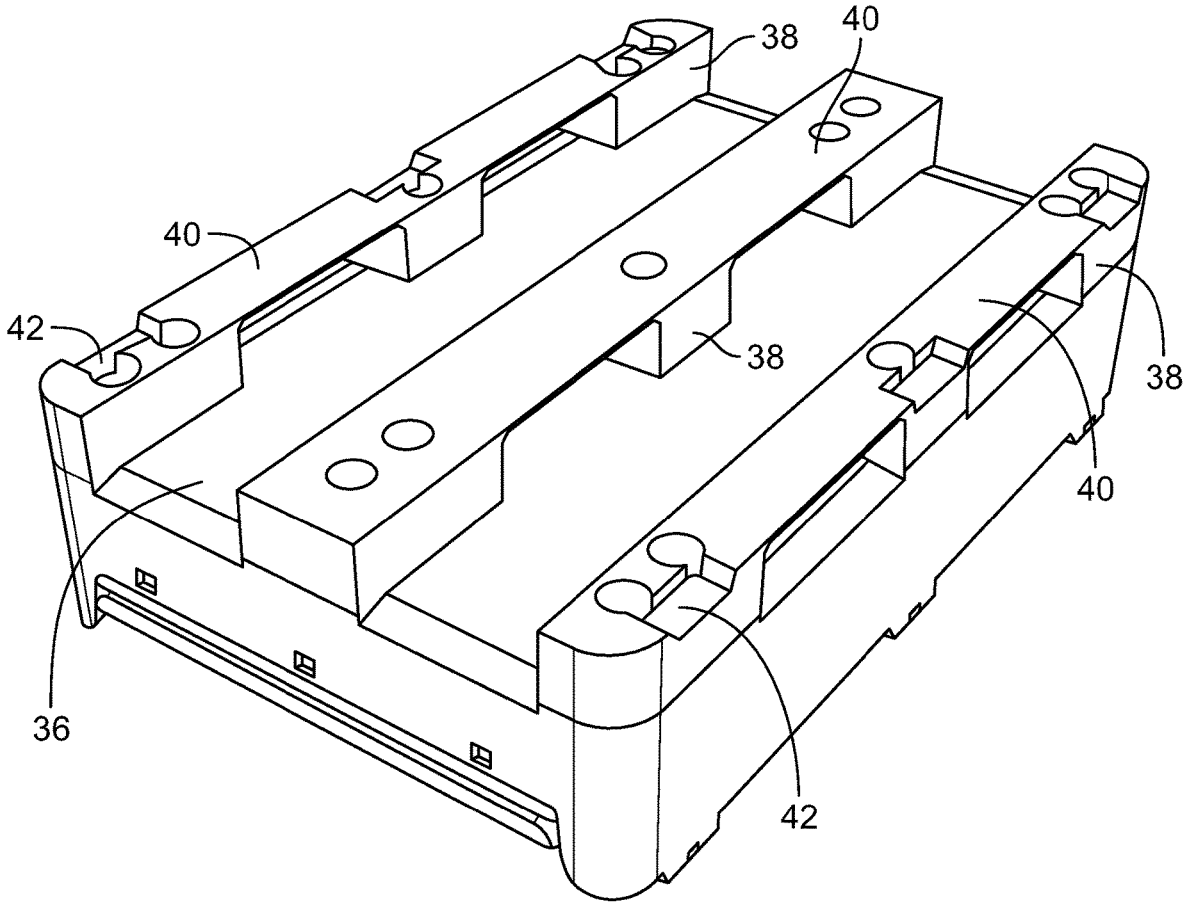
FIG. 4 is a perspective view of the bottom of the collapsed container of FIG. 2.

The bottom of the base portion 22 is shown in FIG. 4. The bottom of the base portion 22 includes a plurality of feet 38 extending (downward, when the container 20 is an upright position) from the bottom wall 36. Runners 40 are connect to the feet 38. In this embodiment, the container 20 includes three parallel runners 40—two outer runners 40 and a middle runner 40. As is evident in FIG. 3, the outer runners 40 and associated feet 38 extend to the outer edge of the container to a surface that is flush with (i.e., planar) the first and second base walls 28, 30, and corresponding side wall panels 24 (when such side wall panels 24 are in an upright, open position). That is, there is no recess from the outer perimeter of the container 20 to the runners 40 or feet 38. Accordingly, any loads applied to the side wall panels 24 and base walls 28, 30 are directly supported by the outer runners 40 and associated feet 38.

Figure 5:
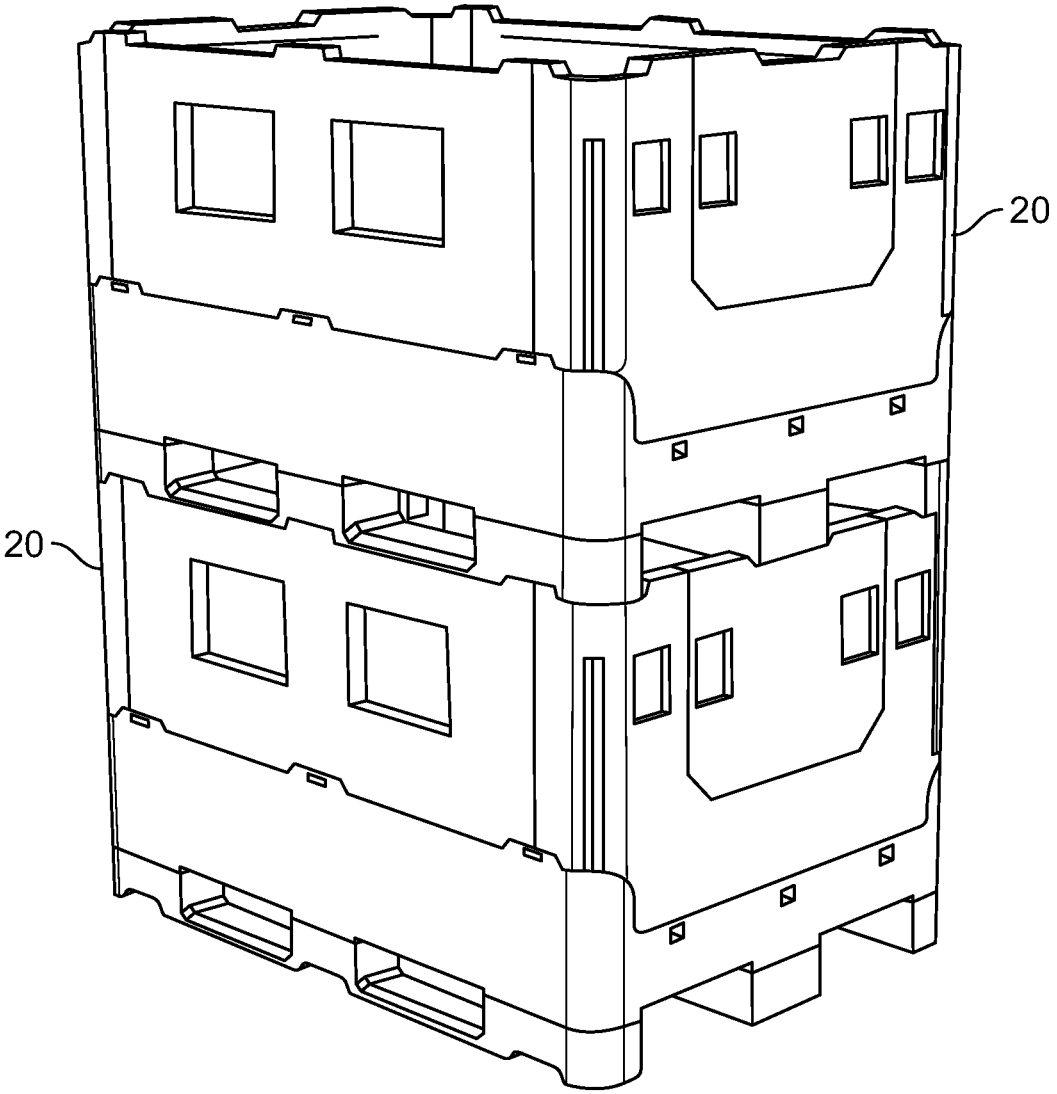
FIG. 5 is a perspective view of two stacked open containers in accordance with the present invention.
Figure 6:
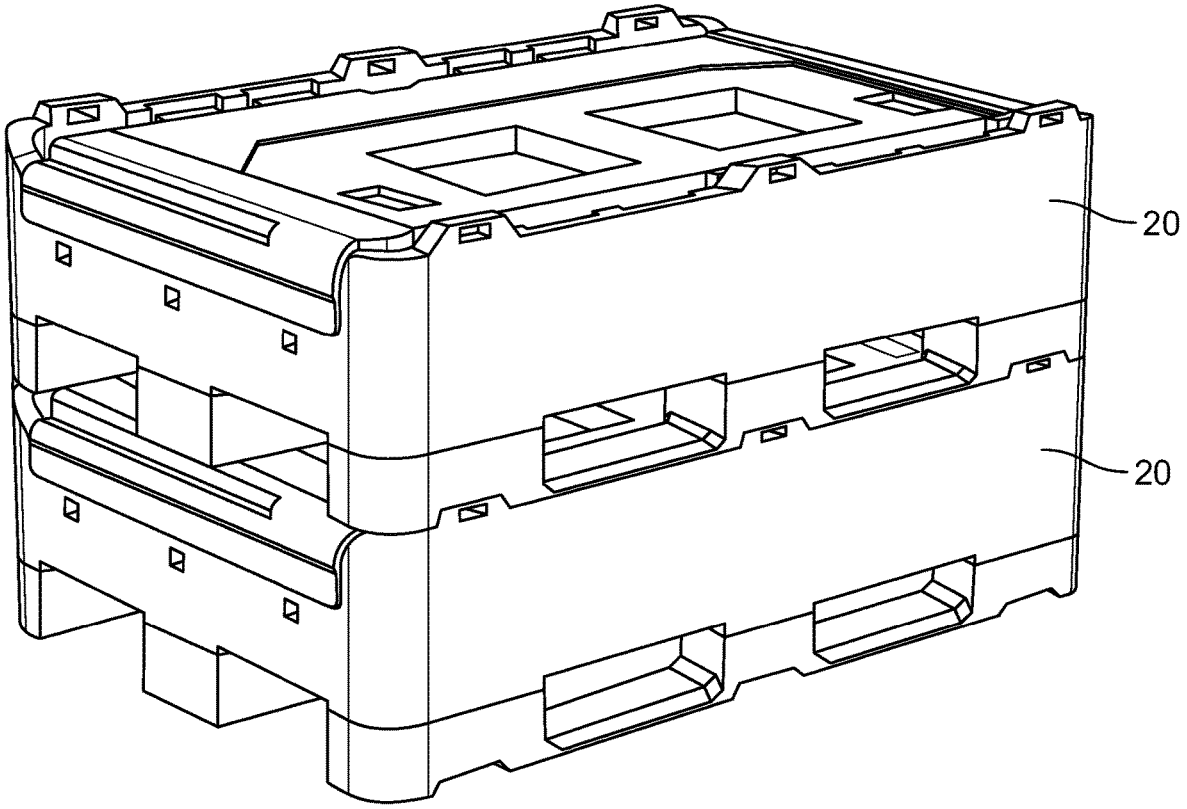
FIG. 6 is a perspective view of two stacked collapsed containers in accordance with the present invention.

To enable the base portion 22 to interlock with another like container 20 (either in the open position or collapsed position), the outer runners 40 and/or feet 38 include notches 42 configured to receive protrusions 26 extending upward from the upper edges 58 from the side wall panels 24, or protrusions 32 extending upward from the upper edges of the base walls 28, 30. An open container 20 stacked on an open container 20, a collapsed container 20 stacked on a collapsed container 20, and a collapsed container 20 stacked on an open container 20—each utilizing the interlocking structures—are shown in FIGS. 5, 6 and 7 respectively.

Figure 7:
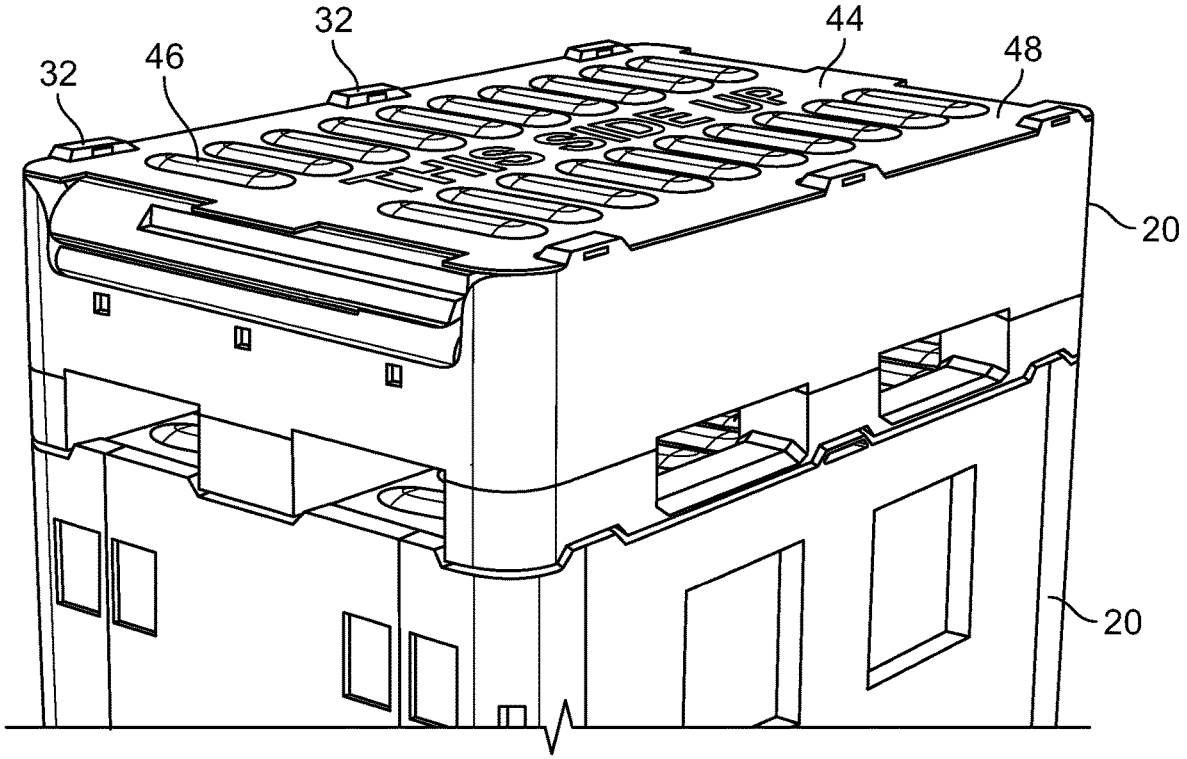
FIG. 7 is a perspective view of a collapsed container stacked on an open container with each container having a dust cover in accordance with the present invention.

Additionally, FIG. 7 shows a dust cover 44 that can be cut from a flat sheet of material (e.g., solid or corrugated plastic). Alternatively, the cover 44 can be formed to have shallow three dimensional shapes 46 as shown in the cover 44 in FIG. 7. The dust cover 44 includes notches 48 positioned to allow passage of the protrusions 26 or 32 in the container 20. In this manner, the protrusions 26 or 32 are used to secure the dust cover 44 to the container 20.

Figure 8:
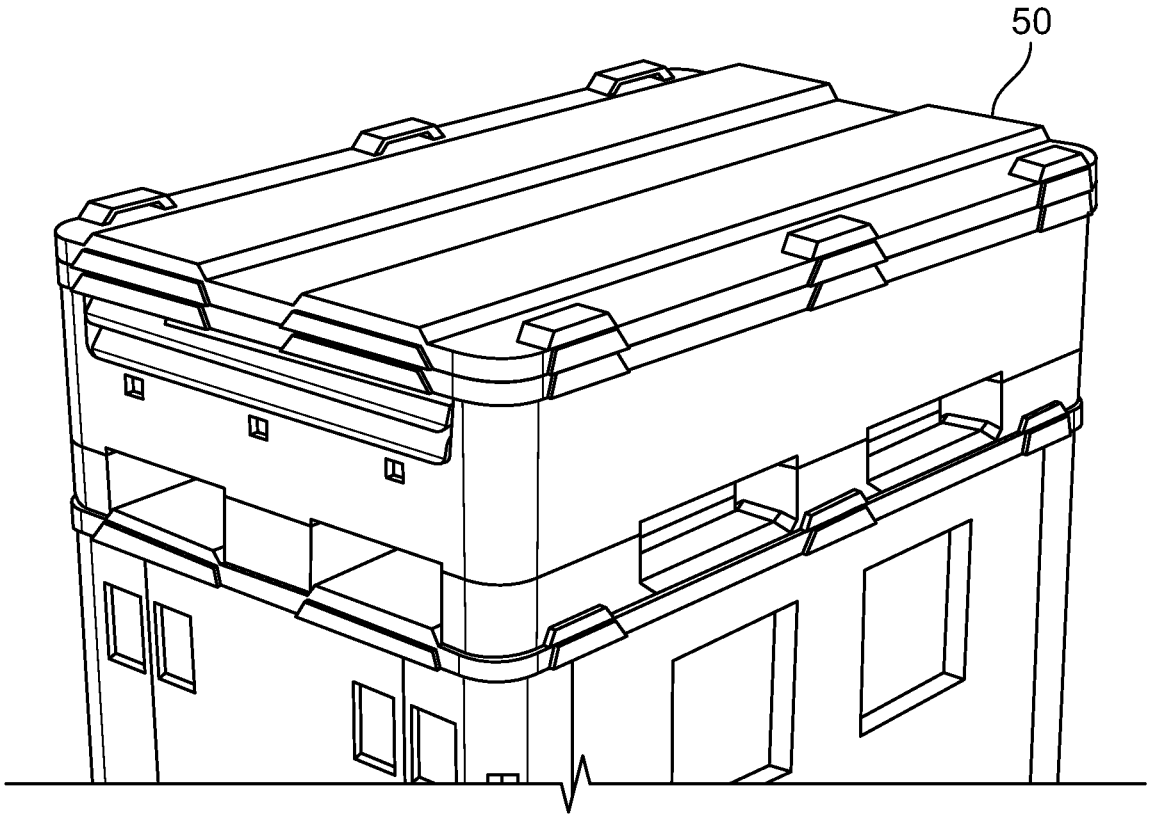
FIG. 8 is a perspective view of a collapsed container stacked on an open container with each container having a low profile cover in accordance with the present invention.
Figure 9:
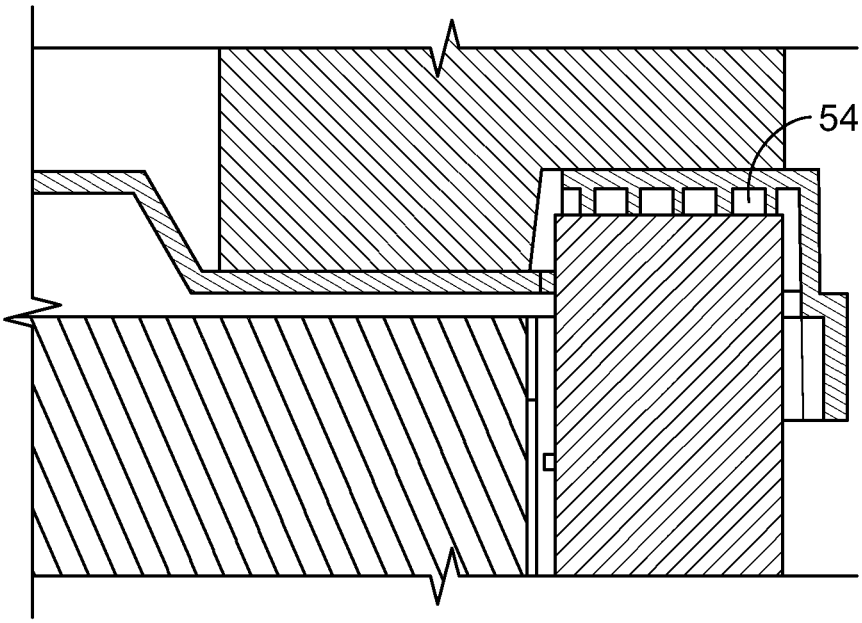
FIG. 9 is a cross-sectional view of a corner portion of the stacked containers of FIG. 14.
Figure 10:
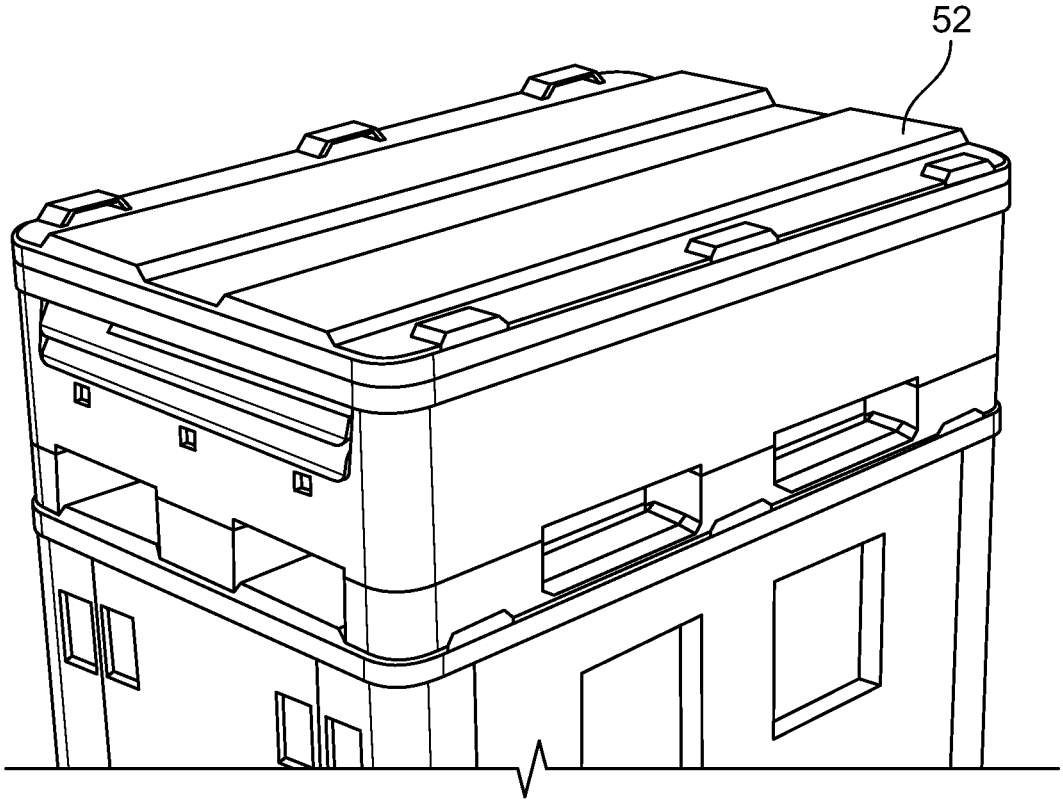
FIG. 10 is a perspective view of a collapsed container stacked on an open container with each container having a top cap in accordance with the present invention.
Figure 11:
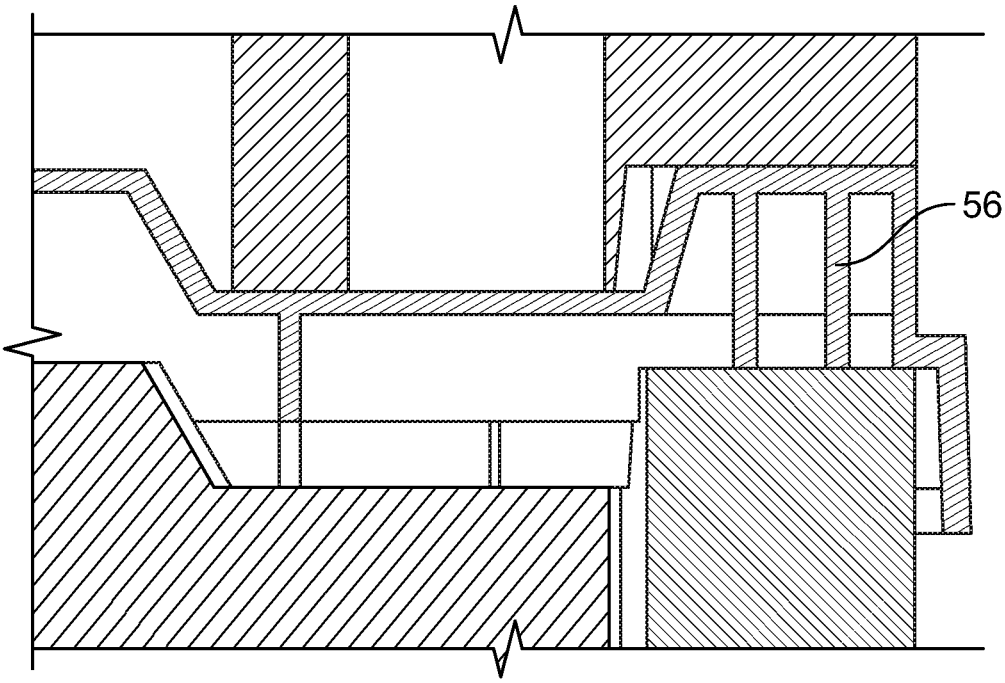
FIG. 11 is a cross-sectional view of a corner portion of FIG. 10.

A low-profile over-fit cover 50 is shown in FIGS. 8 and 9, and an over-fit top cap 52 is shown in FIGS. 10 and 11. Each cap includes structure 54, 56, respectively, replicating the interlocking structure (i.e., protrusions 26 or 32) of the container 20.

Figure 12:
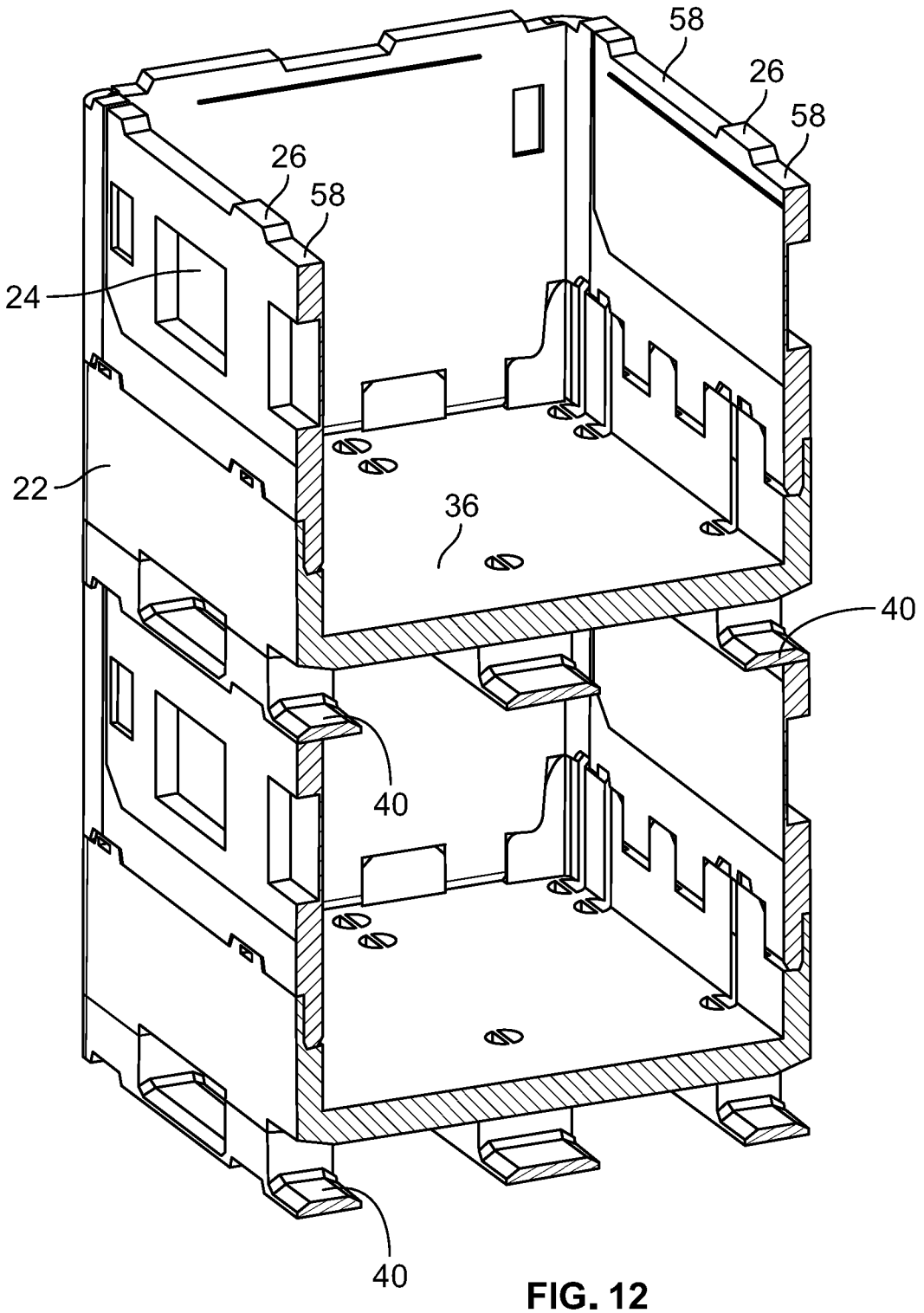
FIG. 12 is a perspective cross-sectional view of stacked containers in accordance with the present invention.

As illustrated in FIG. 12, at least a portion of a bottom surface of the runner 40 (of a top container) rests directly on an upper edge 58 of the side wall 24 (of a lower container). In this instance the runner 40 has a width that is greater than the width of the upper edge 58 of the side wall 24. However, the width of the runner 40 can be modified as necessary, depending on the ultimate size of the containers, to be equal to the width of the upper edge 58, or less than the width of the upper edge 58. The lower surface of the runner 40 can rest on an upper edge of the base wall in a similar fashion.

In both instances (i.e., top crate on side walls of lower crate, or top crate on base walls of lower crate), the top container does not include a recessed portion that fits within the opening of the lower container. Thus the foot print of the top container is greater than a similar container having such a recess (i.e., like that of FIG. 1).

The feet 38 include a lower surface that also rests directly on the upper edge of adjacent side walls. Similar to the runners 40, the feet 38 do not include any portions that are in the interior of a lower container when stacked. This allows for maximum product fill height of the lower container.

Many modifications and variations of the present invention are possible in light of the above teachings. It is, therefore, to be understood within the scope of the appended claims the invention may be protected otherwise than as specifically described.

We claim:

1. A bulk container comprising:

a base having an upstanding rectangular wall having four corners and defining a chamber with an opening at one end and a bottom wall at an opposed end, the rectangular wall having a first outer surface, a first upper surface, and a first plurality of protuberances extend from the first upper surface and are spaced from one another;

four panels are connected to the rectangular wall and each have a second outer surface coplanar to the first outer surface, the four panels having a second upper surface, a pair of spaced protrusions extend from the second upper surface flanking each corner and are offset therefrom to define four side wall protrusions and four end wall protrusions; and, four feet are attached to the bottom wall, one of each of the four feet being positioned at one of each of the four corners and being attached to a portion of the base, each foot of the four feet having a portion removed along a peripheral edge to define a notch, the notch having a reduced height portion that extends to the peripheral edge.

2. The bulk container of claim 1 wherein the four panels are moveable from an open position to a collapsed position.

3. The bulk container of claim 2 wherein when in the collapsed position the first plurality of protuberances extend above the second upper surface.

4. The bulk container of claim 3 wherein the four panels are hingedly connected to the base.

5. The bulk container of claim 4 wherein when in the collapsed position the four panels are positioned in the chamber.

6. The bulk container of claim 1 wherein the rectangular wall has two end edges and two lateral edges and the first plurality of protuberances has a protuberance positioned proximate each corner of the four corners to define corner protuberances.

7. The bulk container of claim 6 further comprising a middle protuberance on each lateral edge positioned between two of the corner protuberances.

8. The bulk container of claim 1 further comprising a first runner connecting a first two feet of the four feet and a second runner connecting a second two feet of the four feet.

9. The bulk container of claim 8 wherein the first runner and the second runner extend along a line parallel to a portion of the rectangular wall.

10. The bulk container of claim 9 wherein the first runner has a lateral edge extending parallel and in registration with a portion of the rectangular wall.

11. A system for forming a stack of bulk containers comprising:

a first container moveable from an open position to a collapsed position comprising:

a first base having a first upstanding rectangular wall having four corners and defining a first chamber with an opening at one end and a bottom wall at an opposed end, the first rectangular wall having a first outer surface, a first upper surface, and a first plurality of protuberances extend from the first upper surface and are spaced from one another;

a first group of four panels are connected to the first rectangular wall and each have a second outer surface coplanar to the first outer surface, the first group of four panels having a second upper surface, a pair of spaced protrusions extend from the second upper surface flanking each corner and are offset therefrom to define four side wall protrusions and four end wall protrusions; and, a first group of four feet are attached to the bottom wall, one of each of the four feet being positioned at one of each of the four corners and being attached to a portion of the base, each foot of the four feet having a portion removed along a peripheral edge to define a notch, the notch having a reduced height portion that extends to the peripheral edge a second container that can be stacked on top of the first container when the first container is in the open position or the collapsed position, the second container comprising:

a second base having a second rectangular wall having four corners and having a third outer surface coplanar with the first outer surface; and, a second group of four feet attached to the second base, one of each of the second group of four feet being positioned at one of each of the four corners of the second rectangular wall, each foot of the second group of four feet having a portion removed along a peripheral edge to define a notch, the notch having a reduced height portion that extends to the peripheral edge, one of each of the notches encompassing one of each of the four side wall protrusions when the second container is stacked on the first container when the first container is in the open position, and one of each of the notches encompassing one of each of the first plurality of protuberances when the second container is stacked on the first container when the first container is in the collapsed position.

12. The system of claim 11 wherein when the first container is in the collapsed position the first plurality of protuberances extend above the second upper surface.

13. The system of claim 12 wherein the first group of four panels are hingedly connected to the base.

14. The system of claim 13 wherein when in the first container is in the collapsed position the first group four panels are positioned in the chamber.

15. The system of claim 11 wherein the first rectangular wall has two end edges and two lateral edges and the first plurality of protuberances has a protuberance positioned proximate each corner of the four corners to define corner protuberances.

16. The system of claim 15 further comprising a middle protuberance on each lateral edge positioned between two of the corner protuberances.

17. The system of claim 11 further comprising a first runner connecting a first two feet of the first group of four feet and a second runner connecting a second two feet of the first group of four feet.

18. The system of claim 17 wherein the first runner and the second runner extend along a line parallel to a portion of the first rectangular wall.

19. The system of claim 18 wherein the first runner has a lateral edge extending parallel and in registration with a portion of the first rectangular wall.

20. The system of claim 11 wherein an outer surface of each foot of the second group of four feet abuts one of each of the four end wall protrusions when the second container is stacked on the first container when the first container is in the open position.

* * * * *